US006415506B1

(12) United States Patent
Baba et al.

(10) Patent No.: US 6,415,506 B1
(45) Date of Patent: Jul. 9, 2002

(54) METHOD OF MANUFACTURING HEAT EXCHANGER

(75) Inventors: Yoshihiro Baba; Toshiki Miyazawa, both of Tokyo (JP)

(73) Assignee: Hidaka Seiki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/588,545

(22) Filed: Jun. 6, 2000

(51) Int. Cl.[7] ..... B23P 15/26

(52) U.S. Cl. ..... 29/890.043; 29/890.047; 29/727

(58) Field of Search ..... 29/890.043, 890.047, 29/727; 72/335, 333, 479

(56) References Cited

U.S. PATENT DOCUMENTS

| | | | | | |
|---|---|---|---|---|---|
| 5,150,520 | A | * | 9/1992 | DeRisi | 29/890.053 |
| 5,604,982 | A | * | 2/1997 | Kent et al. | 29/890.043 |
| 5,640,879 | A | * | 6/1997 | Damsohn et al. | 29/727 |
| 5,644,842 | A | * | 7/1997 | Coleman | 29/890.053 |
| 5,706,695 | A | * | 1/1998 | Helms et al. | 39/890.047 |
| 5,887,476 | A | * | 3/1999 | Damsohn et al. | 72/479 |
| 6,044,554 | A | * | 4/2000 | Potier | 29/890.044 |
| 6,209,201 | B1 | * | 4/2001 | Yamada | 29/890.045 |

FOREIGN PATENT DOCUMENTS

| | | |
|---|---|---|
| JP | A5994538 | 5/1984 |
| JP | A6127131 | 2/1986 |
| JP | A6127132 | 2/1986 |

* cited by examiner

*Primary Examiner*—I Cuda-Rosenbaum
(74) *Attorney, Agent, or Firm*—Birch, Stewart, Kolasch & Birch, LLP

(57) ABSTRACT

In the method of manufacturing a heat exchanger, transverse sectional shapes of heat exchanging tubes can be easily formed into elliptical shapes. The method includes the steps of: piling metallic fins, each of which includes collared through-holes, so as to form tube holes, which are formed by connecting the collared through-holes; piercing heat exchanging tubes, whose transverse sectional shapes are circular shapes, through the tube holes; and inserting expanding bullets, whose transverse sectional shapes are elliptical shapes, into the heat exchanging tubes. The heat exchanging tubes are elliptically expanded to and integrated with the metallic fins.

6 Claims, 7 Drawing Sheets

METHOD OF MANUFACTURING HEAT EXCHANGER

BACKGROUND OF THE INVENTION

The present invention relates to a method of manufacturing a heat exchanger, more precisely relates to a method of manufacturing a heat exchanger for an air conditioner, etc.

A conventional heat exchanging fin 100 is shown in FIG. 9. In a heat exchanger, a plurality of the fins 100 are piled.

The fin 100 is made of a rectangular thin metal plate and includes a plate section 102 and a plurality of collared through-holes 104, which are arranged in the longitudinal direction of the plate section 102. Each of the collared through-holes 104 has a collar 108, which is vertically extended from an edge of a hole section 106, and a flange section 110, which is formed at an upper end of the collar 108. When a plurality of the fins 100 are piled, the flange sections 110 of the fin 100 contact another fin 100, so that the fins 100 can be piled with prescribed separations.

The conventional heat exchanger is manufactured by the steps of: piling a plurality of the fins 100 so as to form a plurality of tube holes 112, each of which is formed by connecting the collared through-holes 104; piercing heat exchanging tubes 114 through the tube holes 112; and inserting expanding bullets 116 into the heat exchanging tubes 114 so as to radially expand the heat exchanging tubes 114 and integrate the heat exchanging tubes 114 with the fins 100 (see FIG. 10).

Transverse sectional shapes of the collars 108 and the heat exchanging tubes 114 are circular shapes. In the conventional method of the heat exchanger, the transverse sectional shapes of the heat exchanging tubes 114 are still circular shapes after the step of expanding the heat exchanging tubes 114.

In the conventional heat exchanger, the circular tubes 114 are integrated with the fins 100. When air is flown, by a fan, in parallel to surfaces of the fins 100, the air is flown perpendicular to the collars 108. Since the transverse sectional shape of the collars 108 are the circular shapes, the air collides with front parts of the collars 108; air turbulent flows (karuman vortex) are generated on rear sides of the collars 108. When frequency of change of pressure, which is caused by the air turbulent flows, coincides with specific oscillation frequency of the heat exchanger, sympathetic vibration is occurred. In the case that drops of dew are formed on surfaces of the heat exchanging tubes 114, the drops of dew are frozen thereon.

To prevent the karuman vortex, heat exchanging tubes, whose transverse sectional shapes are elliptical shapes, are expanded to be integrated with the fins (see Japanese Patent Gazette No. 61-27131). By employing the heat exchanging tubes having the elliptical sectional shapes, the karuman vortex can be reduced and the air can be flown stably.

However, unlike the heat exchanging tubes having the circular sectional shapes, it is difficult to make the heat exchanging tubes having the elliptical sectional shapes, so manufacturing cost of the heat exchanger must be higher.

SUMMARY OF THE INVENTION

An object of the present invention is to provide a method of manufacturing a heat exchanger, in which transverse sectional shapes of heat exchanging tubes can be easily formed into elliptical shapes.

The inventors of the present invention have studied and found that the transverse sectional shapes of the heat exchanging tubes and the collared through-holes can be formed into elliptical shapes by inserting expanding bullets, whose transverse sectional shapes are elliptical shapes, into the heat exchanging tubes having the circular transverse sectional shapes.

Namely, the method of the present invention comprises the steps of:

piling a plurality of metallic fins, each of which includes a plurality of collared through-holes, so as to form a plurality of tube holes, each of which is formed by connecting the collared through-holes;

piercing heat exchanging tubes, whose transverse sectional shapes are circular shapes, through the tube holes; and inserting expanding bullets, whose transverse sectional shapes are elliptical shapes, into the heat exchanging tubes, whereby the heat exchanging tubes are expanded to have elliptical shapes in transverse sections, and the metallic fins are integrated with the heat exchanging tubes.

In the method, an outer major axis of each of the heat exchanging tubes expanded may be greater than an inner diameter of each of the collared through-holes not expanded, and an outer minor axis of each of the heat exchanging tubes expanded may be equal to the inner diameter of each of the collared through-holes not expanded. With this structure, deformation of the metallic fins, which is occurred when the heat exchanging tubes are expanded, can be reduced.

In the method, deformation absorbing sections, which are capable of absorbing deformation of the metallic fin, which occurs in the vicinity of the collared through-holes when the heat exchanging tubes are expanded, may be formed in each of the metallic fins. With this structure, the deformation of the metallic fins can be further reduced when the heat exchanging tubes are elliptically expanded. Note that, the deformation absorbing sections may be circular projections, which respectively enclose the collared through-holes and which are formed by bending the metallic fin.

In the present invention, the heat exchanging tubes, whose transverse sectional shapes are the circular shapes, can be expanded to have the elliptical transverse sectional shapes. Therefore, the heat expanding tubes, which previously have the elliptical transverse sectional shapes, are not required. The conventional heat exchanging tubes, which have the circular transverse sectional shapes, can be used.

In the case of using the heat exchanging tubes whose transverse sectional shapes are the elliptical shapes, the heat exchanging tubes must be correctly positioned. Namely, major axes of the elliptical shapes must be arranged in the direction of airflows in the heat exchanger, then the heat exchanging tubes are expanded.

On the other hand, in the present invention, the heat exchanging tubes, which have the circular transverse sectional shapes, are expanded to have the elliptical sectional shapes, so the heat exchanging tubes may be positioned easily. By correctly attaching the expanding bullets, whose transverse sectional shapes are the elliptical shapes, to a tube expanding machine, major axes of the elliptical sectional shapes of the expanded heat exchanging tubes can be easily arranged in the direction of the air flows in the heat exchanger. Therefore, unlike the conventional method, the heat exchanging tubes can be easily pierced through the tube holes and easily expanded. Further, manufacturing cost of the heat exchanger can be reduced.

BRIEF DESCRIPTION OF THE PREFERRED EMBODIMENTS

The embodiments of the present invention will now be described by way of examples and with reference to the accompanying drawings, in which.

DETAILED DESCRIPTION OF THE PREFERRED EMBODIMENTS

Preferred embodiments of the present invention will now be described in detail with reference to the accompanying drawings.

Figure 1:
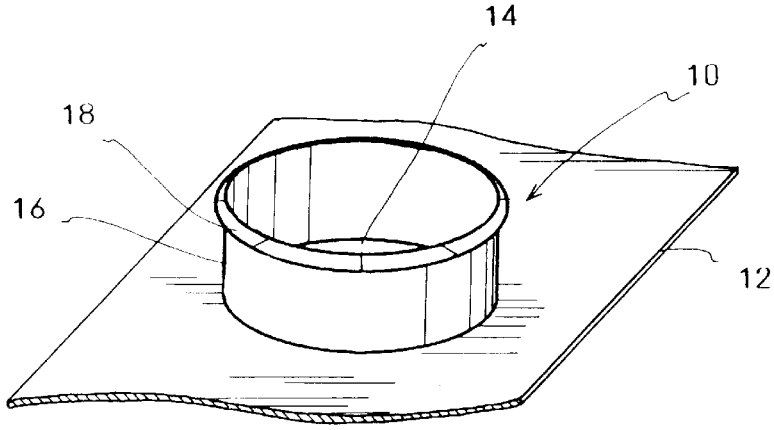
FIG. 1 is a perspective view of a collared through-hole of a metallic fin employed in an embodiment of the present invention.
Figure 9:
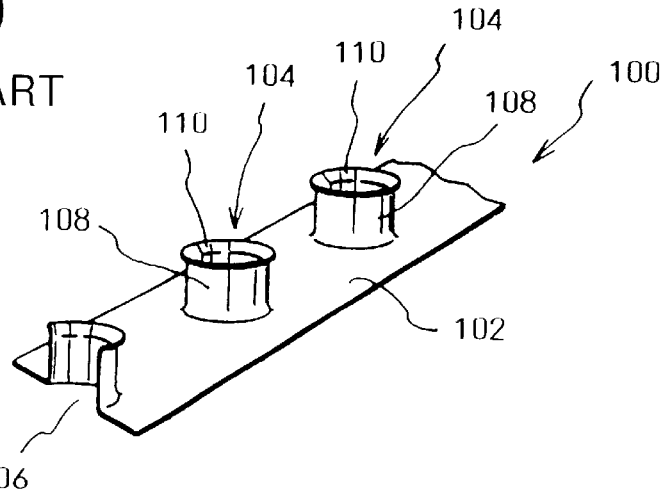
FIG.9 PRIOR ART
FIG. 9 is a perspective view of the fin manufactured by the conventional method.

An example of a collared through-hole is shown in FIG. 1. Actually, a plurality of collared through-holes 10 are linearly arranged in a aluminum plate section 12. Each of the collared through-holes 10 includes: a through-hole section 14; and a collar 16, which is vertically extended from an edge of the through-hole section 14. The collared through-holes 10 are arranged in the longitudinal direction of the fin (the plate section 12) as well as the example shown in FIG. 9.

Figure 10:
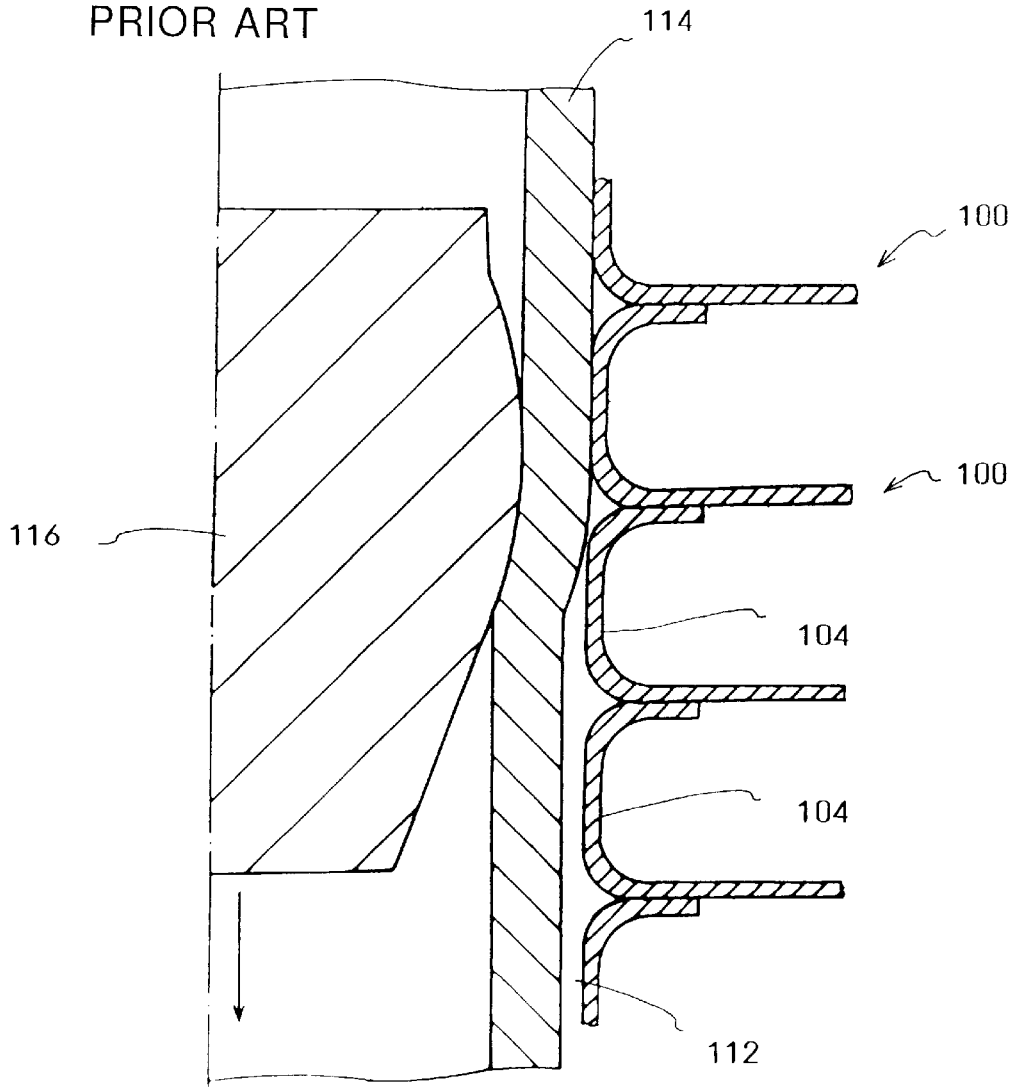
FIG.10 PRIOR ART
FIG. 10 is an explanation view of the conventional tube expanding step.

A plurality of the fins are piled and their collared through-holes are vertically connected so as to form tube holes as well as the example shown in FIG. 10. Each flange section 18, which is formed at an upper end of each collar 16, contacts a bottom face of the plate section 12 of another fin, which is located immediately above, so as to make a prescribed separation between the adjacent fins.

Figure 2:
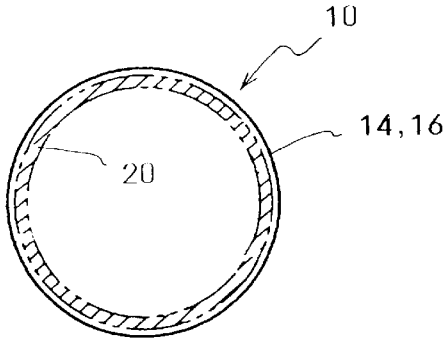
FIG. 2 is an explanation view in which a circular heat exchanging tube is pierced through the collared through-hole shown in FIG. 1.

In the present embodiment, a plurality of heat exchanging tubes, which have circular transverse sectional shapes, are pierced through the tube holes of the piled fins. FIG. 2 shows a state in which the heat exchanging tube 20, which has the circular transverse sectional shape, is pierced through the tube hole. As shown in FIG. 2, the through-hole section 14 and the collar 16 of the collared through-hole 10 have circular transverse sectional shapes. Unlike the conventional method in which the heat exchanging tubes, which have the elliptical transverse sectional shapes, must be correctly positioned and pierced. through the tube holes, the heat exchanging tubes 20 can be freely and easily pierced through the tube holes.

Figure 3A:
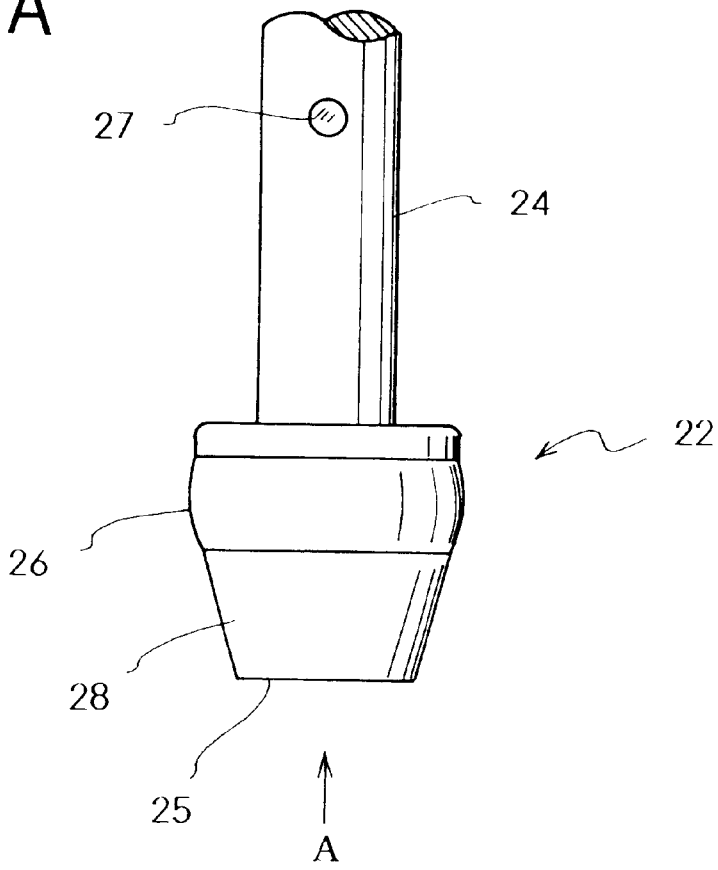
FIG. 3A is a front view of an expanding bullet employed in the embodiment.

Next, the heat exchanging tubes 20, which have been pierced through the tube holes, are expanded to be integrated with the piled fins. The expanding step is executed by inserting expanding bullets 22 (see FIGS. 3A and 3B) into the heat exchanging tubes 20. As shown in FIG. 3A (the front view), the expanding bullet 22 is fixed to a lower end of a mandrel shaft 24, whose upper end is connected to a mandrel plate (not shown) of a tube expanding machine. In FIG. 3A, a vertical pin (not shown) of the bullet 22 is instead in the lower end of the mandrel shaft 24, and a pin 27 is horizontally pierced through the mandrel shaft 24 and the vertical pin of the bullet 22, so that the bullet 22 can be fixed to the mandrel shaft 24.

Figure 3B:
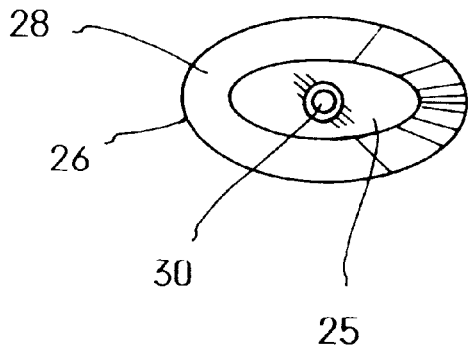
FIG. 3B is a bottom view of the expanding bullet.

FIG. 3B is the bottom view of the expanding bullet 22 seen from a direction of an arrow "A" in FIG. 3A. The bullet 22 has an elliptical external shape. In FIG. 3B, an outermost edge 26 expands the heat exchanging tube 20 to have an elliptical transverse sectional shape. Namely, the outermost edge 26 acts as an expanding section.

In the bullet 22, a guide section 28 is formed between the expanding section 26 and a bottom face 25. The guide section 28 also has an elliptical transverse sectional shape, and area of the elliptical transverse section is gradually reduced toward the bottom face 25. The guide section 28 acts to easily introduce the expanding section 26 into the heat exchanging tube 20.

There is formed an air ventilation hole 30 in the bottom face 25 of the bullet 22. When the bullet 22 is inserted into the tube 20 so as to expand the tube 20, air in the tube 20 is introduced to the upper side of the bullet 22 via the air ventilation hole 30, so that the bullet 22 can be easily moved in the tube 20.

Figure 4A:
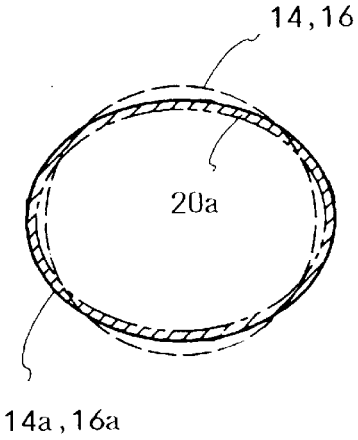
FIGS. 4A and 4B are explanation views showing sectional shapes of the collared through-hole and the heat expanding tube expanded.
Figure 4B:
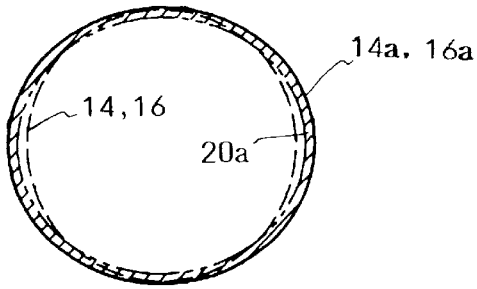

The through-hole section 14*a* and the collar 16*a* of the expanded collared through-hole 10 and the expanded tube 20*a*, which are expanded by the bullet 22 shown in FIGS. 3A and 3B, have elliptical sectional shapes as shown in FIGS. 4A and 4B.

In FIG. 4A, outer major axes of the expanded heat exchanging tube 20*a* and the through-hole section 14*a* and the collar 16*a* of the expanded collared through-hole 10 are greater than an inner diameter of the through-hole section 14 and the collar 16, which are shown by a dotted line, of the collared through-hole 10 not expanded; an outer minor axis of the expanded heat exchanging tube 20*a* is shorter than the inner diameter of the through-hole section 14 and the collar 16 of the collared through-hole 10 not expanded by the bullet 22. By expanding the heat exchanging tube 20 as shown in FIG. 4A, compressing force works to the plate section 12 in the direction of the major axis of the expanded tube 20*a*; tensile force works to the plate section 12 in the direction of the minor axis of the expanded tube 20*a*. By the compressing force and the tensile force, parts of the plate section 12, which are in the vicinity of the collared through-holes 10, are apt to be deformed.

On the other hand, in FIG. 4B, the outer major axes of the expanded heat exchanging tube 20*a* and the through-hole section 14*a* and the collar 16*a* of the expanded collared through-hole 10 are greater than the inner diameter of the through-hole section 14 and the collar 16, which are shown by a dotted line, of the collared through-hole 10 not expanded by the bullet 22; the outer minor axis of the expanded heat exchanging tube 20*a* is equal to the inner diameter of the through-hole section 14 and the collar 16 of the collared through-hole 10 not expanded. By expanding the heat exchanging tube 20 as shown in FIG. 4B, the compressing force and the tensile force, which work to the plate section 12, can be smaller than those of the example shown in FIG. 4A. Therefore, the deformation of the plate section 12, which are occurred in the vicinity of the collared through-holes 10, can be smaller.

Even if the heat exchanging tubes 20 are expanded as shown in FIG. 4B, forming small deformation cannot be avoided. To further reduce the deformation of the plate section 12, a plurality of deformation absorbing sections are formed in the plate section 12.

Figure 5A:
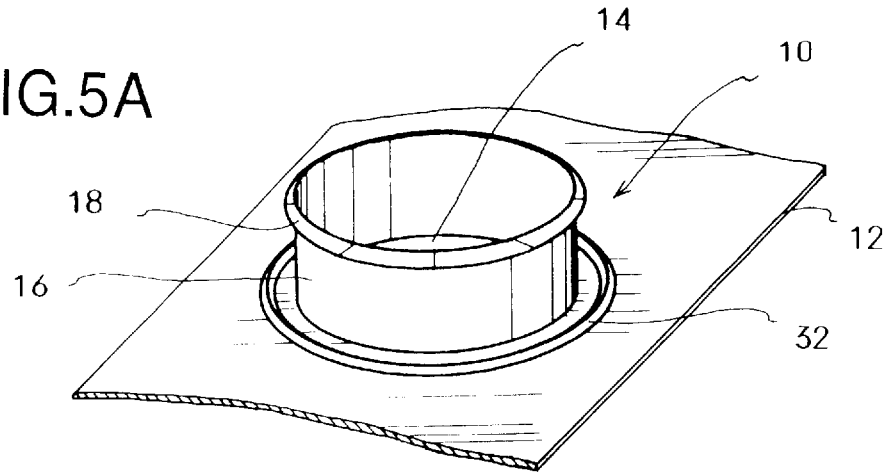
FIGS. 5A–5C are explanation views of another example of the collared through-hole.

An example of the deformation absorbing section is shown in FIG. 5A. A circular projection 32, which is an example of the deformation absorbing section in the plate section 12, is formed to enclose the collared through-hole 10. The circular projection 32 is formed coaxial to the circular collared through-hole 10 (see FIG. 5B). The circular projection 32 can be easily formed by bending a part of the plate section 12, which is in the vicinity of the collared through-hole 10, by proper means, e.g., a press machine (see FIG. 5C).

Figure 5B:
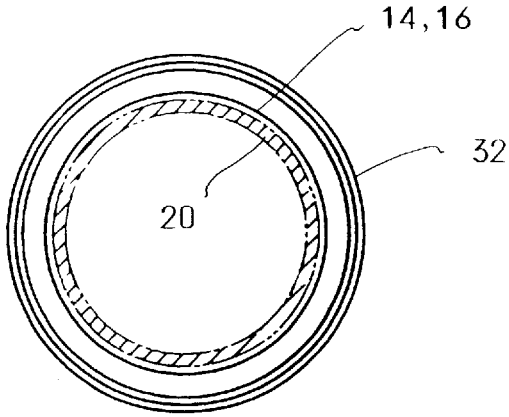
Figure 5C:
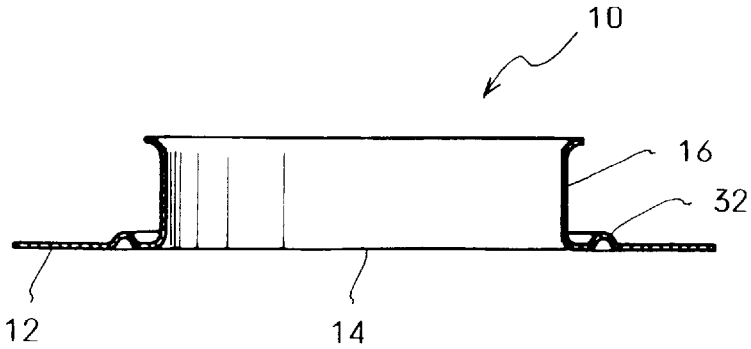

As shown in FIG. 5B, the heat exchanging tube 20, which has the circular transverse sectional shape, is pierced through the collared through-hole 10, which has the circular transverse shape and which is enclosed by the circular projection 32, then the heat exchanging tube 20 is expanded by inserting the expanding bullet 22, which is shown in FIGS. 3A and 3B. In the expanded tube 20*a* (see FIG. 6A), the outer major axis of the expanded heat exchanging tube 20*a* is greater than the inner diameter of the through-hole section 14 and the collar 16, which are shown by a dotted line, of the collared through-hole 10 not expanded by the bullet 22; the outer minor axis of the expanded tube 20*a* is shorter than the inner diameter of the through-hole section 14 and the collar 16 of the collared through-hole 10.

Figure 6A:
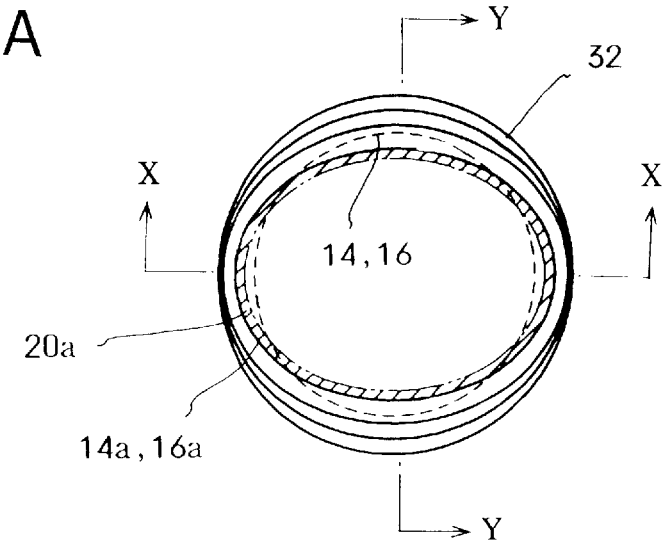
FIGS. 6A–6C are explanation views showing another example of the collared through-hole and the heat expanding tube expanded.
Figure 6B:
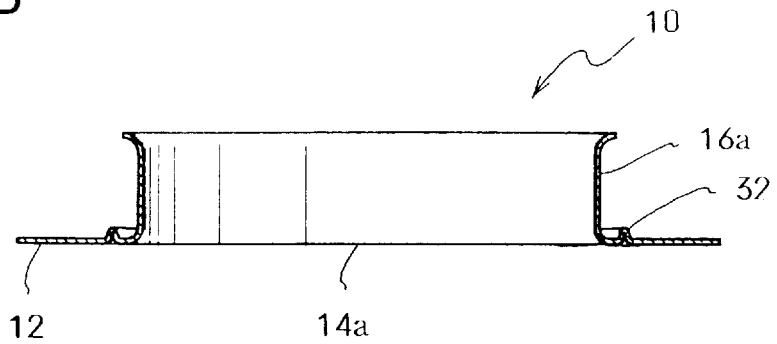

By expanding the heat exchanging tube, parts of the circular projection 32, which correspond to the major axis of the expanded tube 20*a*, are compressed as shown in FIG. 6B, which is the sectional view taken along the line X—X shown in FIG. 6A. Namely, the compressing force works to the plate section 12, but the compressing force is absorbed by compressing the circular projection 32.

Figure 6C:
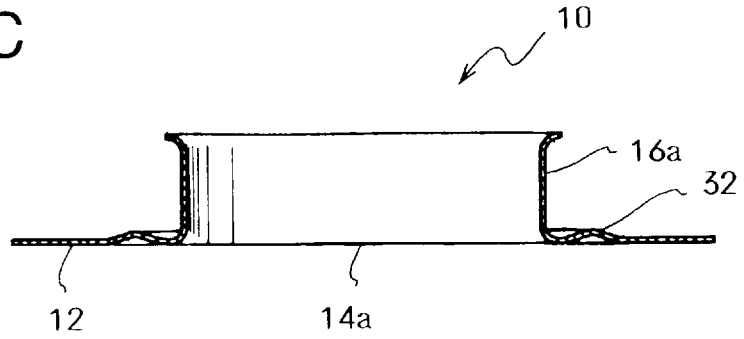

On the other hand, parts of the circular projection 32, which correspond to the minor axis of the expanded tube 20*a*, are extended as shown in FIG. 6C, which is the sectional view taken along the line Y—Y shown in FIG. 6A. Namely, the tensile force works to the plate section 12, but the tensile force is absorbed by extending the circular projection 32.

Since the compressing force and the tensile force, which work to the plate section 12, can be absorbed by deforming the circular projection 32, the deformation of the plate section 12 can be prevented.

Figure 7A:
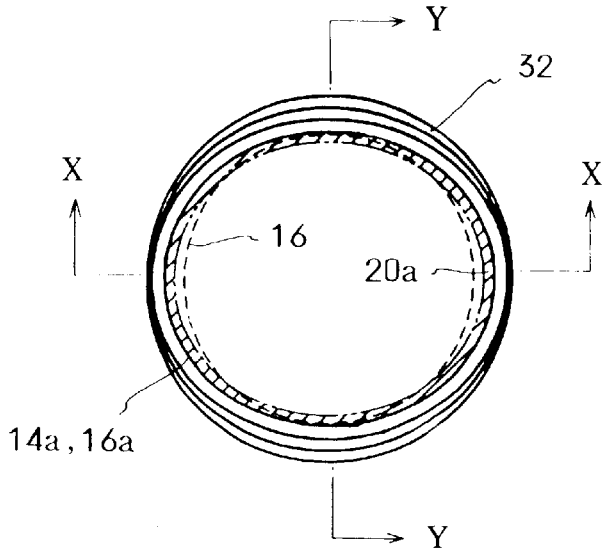
FIGS. 7A–7C are explanation views showing another example of the collared through-hole and the heat expanding tube expanded.

In the expanded tube 20*a* shown in FIG. 7A, the outer major axis of the expanded heat exchanging tube 20*a* is greater than the inner diameter of the through-hole section 14 and the collar 16, which are shown by a dotted line, of the collared through-hole 10 not expanded by the bullet 22; the outer minor axis of the expanded tube 20*a* is equal to the inner diameter of the through-hole section 14 and the collar 16 of the collared through-hole 10.

Figure 7B:
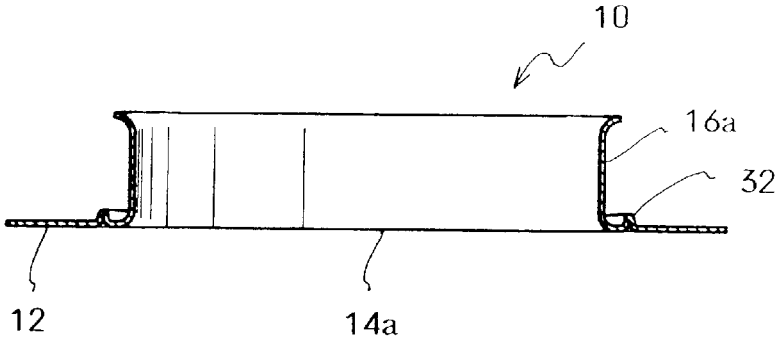

By expanding the heat exchanging tube, parts of the circular projection 32, which correspond to the major axis of the expanded tube 20*a*, are compressed as shown in FIG. 7B, which is the sectional view taken along the line X—X shown in FIG. 7A. Namely, the compressing force works to the plate section 12, but the compressing force is absorbed by compressing the circular projection 32 as well as the example shown in FIG. 6B.

Figure 7C:
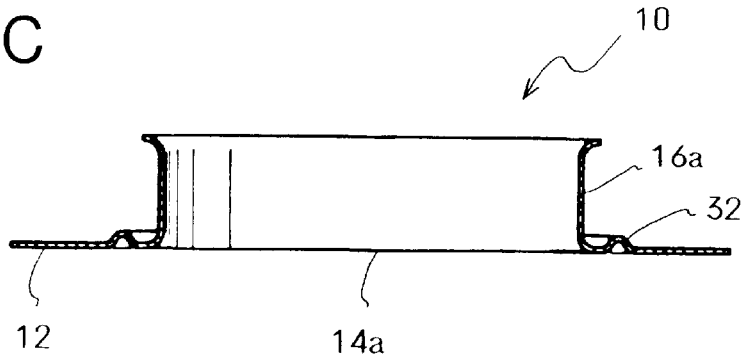

On the other hand, parts of the circular projection 32, which correspond to the minor axis of the expanded tube 20*a*, are extended as shown in FIG. 7C, which is the sectional view taken along the line Y—Y shown in FIG. 7A. The tensile force works to the plate section 12, but the tensile force is absorbed by extending the circular projection 32. In comparison with the example shown in FIG. 6C, degree of extending the circular projection 32 is small. Namely, the tensile force, which works to the plate section 12, of the example shown in FIG. 7A is smaller than that shown in FIG. 6A.

Therefore, in the example shown in FIG. 7A, the deformation of the plate section 12 can be further effectively prevented.

Note that, the circular projection 32 shown in FIGS. 5A–7C is continuously formed to round the collared through-hole 10, but a plurality of projections may be formed to round the collared through-hole 32. In the case of the projections rounding the collared through-hole 32 too, the compressing force and the tensile force can be absorbed.

Figure 8A:
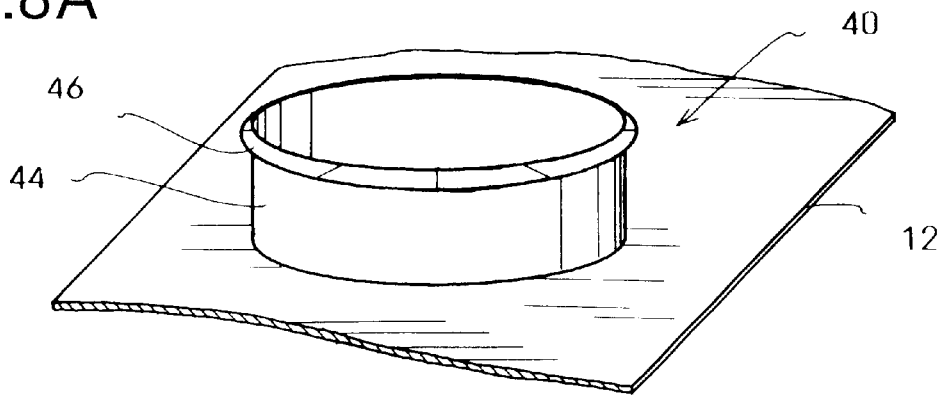
FIGS. 8A–8C are explanation views showing another example of the collared through-hole.
Figure 8B:
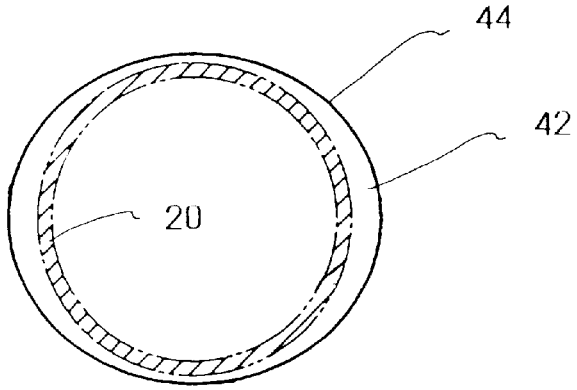
Figure 8C:
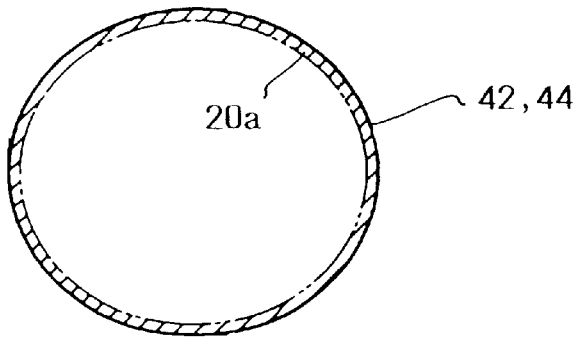

The collared through-hole 10 shown in FIGS. 1–7C has the circular transverse sectional shape. The present invention may be applied to a collared through-hole 40 shown in FIGS. 8A–8C. In FIGS. 8A–8C, an elliptical through-hole section 42 is bored in a plate section 42, and a collar 44 of the collared through-hole 40 is vertically extended from an edge of the elliptical through-hole section 42. There is formed a flange section 46 at an upper end of the collar 44.

The heat exchanging tube 20, which has the circular transverse sectional shape, is pierced through the collared through-hole 40 (the tube hole) as shown in FIG. 8B. Then the expanding bullet 22, which is shown in FIGS. 3A and 3B, is inserted into the tube 20 to expand the tube 20. The transverse sectional shape of the expanded tube 20*a* is equal to that of the through-hole section 42 and the collar 44 of the collared through-hole 40 (see FIG. 8C).

In the case shown in FIGS. 8A–8C, the compressing force and the tensile force do not work in specific directions, so no deformation absorbing sections are required in the plate section 12.

In the present invention, the heat exchanging tubes, which have the elliptical transverse sectional shapes, can be easily integrated with the heat exchanging fins. Therefore, the heat exchanger can be easily manufactured, so the manufacturing cost of the heat exchanger can be reduced. In the heat exchanger, the turbulent airflows can be effectively prevented, so that heat exchanging efficiency of the heat exchanger, e.g., an air conditioner, can be improved.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A method of manufacturing a heat exchanger, comprising the steps of:

piling a plurality of metallic fins, each of which includes a plurality of circular collared through-holes, so as to form a plurality of tube holes, each of which is formed by connecting said circular collared through-holes;

piercing heat exchanging tubes, whose transverse sectional shapes are circular shapes, through said tube holes, wherein orienting said transverse sectional shapes of said heat exchanging tubes relative to transverse sections of said collared through-holes is avoided;

inserting expanding bullets, whose transverse sectional shapes are elliptical shapes which are gradually reduced toward a bottom side, into said heat exchanging tubes, thereby expanding said heat exchanging tubes, transforming their transverse sections from circular shapes to elliptical shapes, and integrating said heat exchanging tubes with said metallic fins.

2. The method according to claim 1, wherein an outer major axis of each of said heat exchanging tubes expanded is greater than an inner diameter of each of said collared through-holes not expanded, and an outer minor axis of each of said heat exchanging tubes expanded is equal to the inner diameter of each of said collared through-holes not expanded.

3. The method according to claim 2, wherein deformation absorbing sections, which are capable of absorbing deformation of said metallic fin, which occurs in the vicinity of said collared through-holes when said heat exchanging tubes are expanded, are formed in each of said metallic fins.

4. The method according to claim 3, wherein said deformation absorbing sections are circular projections, which respectively enclose said collared through-holes and which are formed by bending said metallic fin.

5. A method of manufacturing a heat exchanger comprising the steps of:

piling a plurality of metallic fins, each of which includes a plurality of circular collared through-holes surrounded by circular deformation absorbing sections having projections capable of absorbing deformation of said metallic fins, which occurs in the vicinity of said circular collared through-holes, the piling forming a plurality of tube holes, each of which is formed by connecting said circular collared through-holes;

piercing heat exchanging tubes, whose transverse sectional shapes are circular shapes, through said tube holes, wherein orienting transverse sectional shapes of said heat exchanging tubes relative to transverse cross sections of said collared through-holes is avoided;

inserting expanding bullets, whose transverse sectional shapes are elliptical shapes which are gradually reduced toward a bottom side, into said heat exchanging tubes, thereby expanding said heat exchanging tubes, transforming their transverse sections from circular shapes to elliptical shapes, whose outer major axes are greater than inner diameters of said collared through-holes not expanded and whose outer minor axes are equal to the inner diameters thereof, in transverse sections, causing said deformation absorbing sections to absorb the deformation resulting from the expanding tubes, and integrating said heat exchanging tubes with said metallic fins.

6. A method of manufacturing a heat exchanger, comprising the steps of:

piling a plurality of metallic fins, each of which includes a plurality of collared through-holes, so as to form a plurality of tube holes, each of which is formed by connecting said collared through-holes;

piercing heat exchanging tubes, whose transverse sectional shapes are circular shapes, through said tube holes, wherein orienting said transverse sectional shapes of said heat exchanging tubes relative to transverse sections of said collared through-holes is avoided;

inserting expanding bullets, whose transverse sectional shapes are elliptical shapes which are gradually reduced toward a bottom side, into said heat exchanging tubes, thereby expanding said heat exchanging tubes, transforming their transverse sections from circular shapes to elliptical shapes, and integrating said heat exchanging tubes with said metallic fins.

* * * * *